US005995074A

United States Patent [19]

Kusafuka et al.

[11] Patent Number: 5,995,074

[45] Date of Patent: Nov. 30, 1999

[54] DRIVING METHOD OF LIQUID CRYSTAL DISPLAY DEVICE

[75] Inventors: Kaoru Kusafuka; Hidehisa Shimizu, both of Sagamihara; Shinichi Kimura, Yokohama, all of Japan

[73] Assignee: International Business Machines Corporation, Armonk, N.Y.

[21] Appl. No.: 08/742,335

[22] Filed: Nov. 1, 1996

[30] Foreign Application Priority Data

Dec. 18, 1995 [JP] Japan ..... 7-329187

[51] Int. Cl.[6] ..... G09G 3/36

[52] U.S. Cl. ..... 345/90; 345/95; 345/210

[58] Field of Search ..... 345/90–96, 203–206, 345/208–210

[56] References Cited

U.S. PATENT DOCUMENTS

| | | | |
|---|---|---|---|
| 4,955,697 | 9/1990 | Takeda et al. | 345/92 |
| 5,151,805 | 9/1992 | Takeda et al. | 359/57 |
| 5,296,847 | 3/1994 | Takeda et al. | 345/208 |
| 5,574,582 | 11/1996 | Takeda et al. | 349/42 |
| 5,602,560 | 2/1997 | Ikeda | 345/94 |
| 5,686,932 | 11/1997 | Tomita | 345/94 |
| 5,691,739 | 11/1997 | Kawamori et al. | 345/94 |
| 5,748,169 | 5/1998 | Okumura et al. | 345/94 |

FOREIGN PATENT DOCUMENTS

| | | | |
|---|---|---|---|
| 0536744A2 | 10/1991 | Japan | G09G 3/36 |
| 0536744A3 | 10/1991 | Japan | G09G 3/36 |
| 0657864A1 | 6/1994 | Japan | G09G 3/36 |

*Primary Examiner*—Amare Mengistu
*Assistant Examiner*—Ricardo Osorio
*Attorney, Agent, or Firm*—J. P. Sbrollini

[57] ABSTRACT

A method of driving liquid crystal display devices is provided which results in superior image quality and reliability and can reduce the power consumption even with increased gate line loads resulting from increased size of the display area, improved resolution, and an increased aperture ratio in active matrix liquid crystal display devices in which switching elements such as thin-film transistors (TFTs) and pixel electrodes are arranged in matrix form. At the first stage, occurrence of a DC component due to gate delaying is prevented by outputting a compensation voltage at the same timing as a gate-off timing so as to attain a condition of $\Delta V=0$. Thereafter, the second compensation voltage is output so that $\Delta V$ becomes a target value. Since the second output is not influenced by the gate delaying, $\Delta V$ can be made large.

15 Claims, 7 Drawing Sheets

DRIVING METHOD OF LIQUID CRYSTAL DISPLAY DEVICE

FIELD OF THE INVENTION

The subject invention relates to a driving method of an active matrix liquid crystal display device in which switching elements such as thin-film transistors (TFTs) and pixel electrodes are arranged in matrix form.

BACKGROUND OF THE INVENTION

In recent years, attempts have been made to greatly improve the display quality of active matrix liquid crystal display devices. Many techniques have been proposed to solve problems such as image flicker and "image sticking" in which a fixed (still) image remains immediately after its display as if it had been burnt in. Flicker and burning-in, both of which deteriorate the display quality, are caused by a DC voltage component that unavoidably occurs in a display pixel due to anisotropy in the dielectric constant of a liquid crystal. In addition, techniques have been proposed for reducing the power consumption of active-matrix liquid crystal display devices to allow even a battery to drive them for a long time because the devices are used in a variety of portable apparatuses such as notebook-type computers.

A brief description will be made of the configuration of an active matrix liquid crystal display device that uses thin-film transistors (TFTs) as switching elements. To begin with, the liquid crystal is sealed between two glass substrates, i.e., an array substrate and an opposed substrate. A number of gate lines are formed on the array substrate horizontally, for instance, and a number of data lines are then formed thereon vertically over an insulating film. Pixel regions are formed with pixel electrodes in regions of the matrix sectioned by the gate lines and data lines. A TFT is formed in each pixel region, and a gate electrode and a drain electrode of the TFT is connected to the gate line and the data line, respectively. The TFTs source electrode is connected to a pixel electrode. The data lines are driven by a gate driving circuit and the data lines are driven by a data line driving circuit.

In an active matrix liquid crystal display, auxiliary capacitors are separately disposed because the liquid crystal pixel capacitance is small. The auxiliary capacitor is called a Cs-on-gate type in which a pixel electrode is laid on the gate line immediately preceding the gate line that is connected to the pixel concerned, and a storage capacitance type in which an independent wiring line (storage capacitance line) is formed.

FIG. 3 shows an equivalent circuit of display pixels of a liquid crystal display device in which additional capacitance type auxiliary capacitors are formed. Drain electrodes of TFTs 6 are connected to a plurality of data lines 4 attached to data line driving circuits (not shown). Gate electrodes of the TFTs 6 are connected to a plurality of gate lines 2 that are connected to gate line driving circuits (not shown). Source electrodes of the TFTs 6 are connected to respective display electrodes. The liquid crystal between the display electrodes on the array substrate and a common electrode on the opposed substrate constitutes the liquid crystal capacitances Cls 8. Part of each display electrode is laid on a gate line 2 of the immediately preceding scanline, to constitute an auxiliary capacitor Cs 10. A parasitic capacitance Cgs 12 exists between the gate and source of the TFT 6.

Recent active matrix liquid crystal display devices having the above configuration, have required that the display screen have higher resolution and the number of display pixels be increased. In association with these requirements, solutions have been proposed to various technical problems that have arisen. For example, Japanese Published Unexamined Patent Applications Nos. 2-157815 and 7-140441 disclose methods that can lower the degree of image flicker and the burning-in phenomenon, and also reduce power consumption. This is accomplished by compensating for a DC component that unavoidably occurs due to anisotrophy of a liquid crystal. However, these disclosed methods do not consider that the miniaturization of the gate lines, the increase in the number of wiring lines, and the increase of the wiring length, associated with improved resolution of the display screen and an increased number of display pixels, will increase the resistance of the gate lines and the load capacitance, and cause gate delaying. Nor do these disclosures solve the problem that gate delaying causes a variation in gradations and DC components having different levels in the horizontal direction of the display screen.

Gate delaying is considered an unavoidable problem in view of the improved resolution and the increased aperture ratio that are needed to increase the demand of liquid crystal display devices. For example, although gate delaying may be reduced by making the gate lines wider, that solution will decrease the aperture ratio of display pixels. As a result, to obtain given display brightness, the light intensity from a backlight needs to be increased, resulting in increased power consumption.

Further, in a method disclosed in Japanese Published Unexamined Patent Application No. 5-100636, a pixel voltage is written twice per frame to decrease a pixel potential variation caused by a reduced write period that results from improved resolution of the display. This method addresses the shortening of the gate on-time which results from the improved resolution of the display, but is not intended to solve the problem of a variation component (hereinafter called a feedthrough voltage) of the pixel potential which is caused by the parasitic capacitance between the gate and source of a TFT. Nor does this method consider that gate delaying causes different feedthrough voltages at various positions on the screen. Therefore, as in the case of the previously mentioned methods, this method reduces the aperture ratio of display pixels, resulting in increased power consumption.

Now, referring to FIGS. 4–7, a conventional liquid crystal driving method will be described in a more specific manner. The following explanation assumes a normally-black type liquid crystal display device in which the display brightness increases as the liquid crystal application voltage is increased. Drive waveforms shown in FIGS. 4 and 5 are adapted to compensate for both of a feedthrough voltage and an effective value. The effective value compensation means increasing the liquid crystal application voltage by adjusting a voltage applied to the auxiliary capacitor constituted by the gate line and the display electrode, even if the voltage level of gradation data supplied to the data line is decreased as a whole. The effective value compensation allows the liquid crystal to produce high brightness or receive a high voltage, even if the level of a voltage supplied to the data line is low. Since the level of a voltage supplied to the data line can be lowered, the power consumption of the liquid crystal display device can be reduced.

FIG. 4 shows a case where frame inversion driving is performed on a Cs-on-gate type liquid crystal display device. Parts (a) and (b) and part (c) respectively show input waveforms and a liquid crystal drive waveform on the side close to the gate line driving circuit, in which waveforms no gate delaying occurs.

When a gate signal (pulse width: 1 H (one horizontal scanning period) 22 is input to a gate line Gn+1 (see FIG.

4(*b*)), a TFT connected to this gate line is turned on, so that a voltage is applied to the liquid crystal as shown in FIG. 4(*c*). When the TFT is turned off, that is, at the fall of the gate signal 22, the feedthrough phenomenon causes the write voltage to the liquid crystal to decrease by a feedthrough voltage component 28 as shown in FIG. 4(*c*).

Thereafter (for instance, after a lapse of 0.5 H from the fall of the gate signal 22), feedthrough voltage compensation and effective value compensation 30 are effected as shown in FIG. 4(*c*) by causing a previous gate line Gn to have a potential Vc1 and applying a voltage to the auxiliary capacitor Cs. Further, final effective value compensation 32 is effected by supplying a signal of Vc1 to the gate line Gn+1 after a lapse of about 1 H from the rise of Vc1. As a result, the liquid crystal potential is set at Vlc(+) during frame 1.

Next, to AC-drive the liquid crystal in frame 2, feedthrough voltage compensation and effective value compensation are performed by a process similar to that in frame 1 at a voltage level Vc2 so that the liquid crystal potential becomes Vlc(−). As a result, a condition Vlc(+)=Vlc(−) is established, which enables liquid crystal display to be free of a DC component and be low in power consumption.

However, as described above, where gate delaying occurs, a gate signal assumes a waveform distortion as shown, for instance, in FIG. 6 at a position closer to a gate line terminal portion, so that the gate-off timing is delayed by Δt from 1 H. As a result, as shown in FIG. 5, the feedthrough amount decreases because a gate-source current flows for a longer time by an increased gate-on time than in the case of no gate delaying (FIG. 4). However, since the voltage levels Vc1 and Vc2 for the feedthrough voltage and effective value compensation do not vary, the liquid crystal potential becomes higher than a desired value (broken line in FIG. 5) in frame 1 and lower than that in frame 2. This causes a DC component Vdc (Vdc=Vlc(+)−Vlc(−)). That is, as shown in FIG. 7, while desired feedthrough/effective value compensation is effected for pixels closer to the gate line driving circuit (indicated as "supply side" in the figure), a DC component occurs for pixels closer to the gate line terminal portions so as to be larger at positions closer to the terminal portions.

In connection with the above problem, consideration is given to the case where drive waveforms as shown in FIG. 8 are used. In the drive waveforms of FIG. 8, the fall timing of a gate signal 22 that is input to a gate line Gn+1 is made coincident with a timing at which the potential level of a previous gate line Gn is raised to Vc1. In this case, even if the gate delaying causes the feedthrough voltage to be smaller at a position closer to a gate line terminal portion, it also makes the compensation potential Vc1 to appear smaller. Thus, the liquid crystal potential is prevented from having a DC component.

However, this driving method cannot provide sufficient effective value compensation for changing the amplitude of the liquid crystal potential, because the compensation voltage Vc1 appears smaller at a position closer to a gate line terminal portion. As shown in FIG. 9(*c*), although liquid crystal potentials V'lc(+) and V'lc(−) have no DC component (V'lc(+)=V'lc(−)), they are smaller than desired values Vlc (+) and Vlc(−), respectively.

As a result, as shown in FIG. 10, while desired feedthrough/effective value compensation can be effected for pixels closer to the gate line driving circuit (supply side pixels), the brightness decreases at pixels closer to the gate line terminal portions, causing unevenness in brightness over the entire display screen. As such, in either driving method, the gate delaying prevents the feedthrough voltage compensation and the effective value compensation from being effected at the same time. Therefore, it is impossible to lower the degrees of a flicker and the burning-in phenomenon and, at the same time, reduce the power consumption.

Therefore, an object of the subject invention is to provide a driving method of for active matrix liquid crystal display devices which method is superior in image quality and reliability and can reduce the power consumption even if the gate line load is increased as a result of increased size of a display screen, improved resolution, and an increased aperture ratio.

BRIEF SUMMARY OF THE INVENTION

In an active matrix liquid crystal display device in which TFTs are used as switching elements, a potential variation ΔVg of a gate signal causes, via a gate-source parasitic capacitance, a feedthrough voltage ΔVg*Cgs/Call in the negative direction with respect to a pixel potential, where Cgs is a gate-source parasitic capacitance and call is the capacitance of the entire pixel. It is assumed that Call=Cs+Cgs+Clc where Cs is an auxiliary capacitance and Clc is a liquid crystal capacitance.

Since the capacitance of the liquid crystal varies due to anisotropy of its dielectric constant, the feedthrough voltage have different values for different liquid crystal application voltages. As for the principle of compensating for the feedthrough voltage, by applying two different compensation voltages Vc(+) and Vc(−) via Cs for positive and negative write operations, pixel potential variations of Vc(+)*Cs/Call, and Vc(−)*Cs/Call are superimposed. The occurrence of a DC component is suppressed irrespective of a capacitance variation of the liquid crystal by satisfying the following Equation (1):

$$(Vc(+)*Cs/Call - Vg*Cgs/Call) = (Vc(-)*Cs/Call - Vg*Cgs/Call) = \Delta V \quad (1)$$

With the two compensation voltages, it becomes possible to make the liquid crystal application voltage larger than a voltage supplied from a signal line by ΔV, which is shown in Equation (1). Thus, it becomes possible to reduce the output voltage of a source driver as well as the driving power.

However, the above driving method has a problem of being influenced by a signal delay of a gate voltage (signal delays in both of a Cs line and a gate line in a case where Cs is independent). Since the gate delaying causes the feedthrough voltage to become smaller at the end of a gate line, a voltage that is compensated for via Cs becomes larger to cause a DC component.

One method of solving this problem would be to make an adjustment between a gate-off timing and a timing of compensation voltage output. Although this method can prevent occurrence of a DC component, it is defective in that the liquid crystal application voltage varies if the amplitudes of the two compensation voltages are made too large. Therefore, ΔV cannot be made large and it becomes difficult to reduce the driving power.

The subject invention solves the above problems by outputting the compensation voltage at two different times. That is, the first compensation voltage is provided at a gate-off time so as to satisfy ΔV=0, to thereby prevent occurrence of a DC voltage due to gate delaying. Thereafter, the second compensation voltage is provided so that ΔV becomes a target value. Since the second output is not influenced by gate delaying, ΔV can be made large.

The above object is attained by a driving method of a liquid. crystal display device which method is characterized in that a pixel signal of a data line is written to a display electrode by turning on a thin-film transistor by applying a gate signal to a gate line, and that after feedthrough voltage compensation is effected by applying a feedthrough voltage compensation voltage to an auxiliary capacitor, a given liquid crystal potential is applied to a liquid crystal in each pixel region by applying an effective value compensation voltage.

Further, the above object is attained by a driving method of a liquid crystal display device which method is characterized in that, in the above driving method of a liquid crystal display device, the feedthrough voltage compensation voltage is applied approximately at the same timing as a fall timing of the gate signal.

Further, the above is attained by a driving method of a liquid crystal display device which method is characterized in that, in the above driving method of a liquid crystal display device, the effective value compensation voltage is applied after the thin-film transistor is turned off after application of the feedthrough voltage compensation voltage.

Still further, the above object is attained by a driving method of a liquid crystal display device which method is characterized in that, in the above driving method of a liquid crystal display device, the auxiliary capacitor is constituted of a previous gate line of the gate line and the display electrode, and the feedthrough voltage compensation voltage and the effective value compensation voltage are applied to the previous gate line, or a driving method of a liquid crystal display device which method is characterized in that, in the above driving method of a liquid crystal display device, the auxiliary capacitor is constituted of an independent storage capacitance line and the display electrode, and the feedthrough voltage compensation voltage and the effective value compensation voltage are applied to the storage capacitance line.

According to the invention, the display quality and the reliability can be improved and the power consumption can be reduced by reducing the drive power, suppressing occurrence of a DC voltage due to anisotropy of the dielectric constant of a liquid crystal, and preventing a variation of a liquid crystal application voltage due to gate delaying in the TFT/LCD driving and voltage setting methods.

DETAILED DESCRIPTION

Figure 1A:
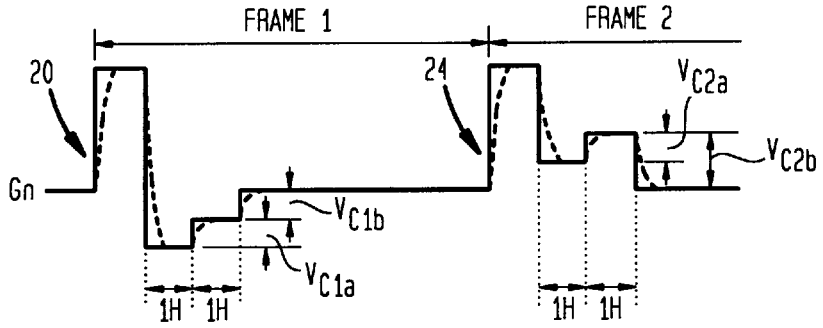
FIG. 1 illustrates a driving method of a liquid crystal display device according to an embodiment of the subject invention.
Figure 1B:
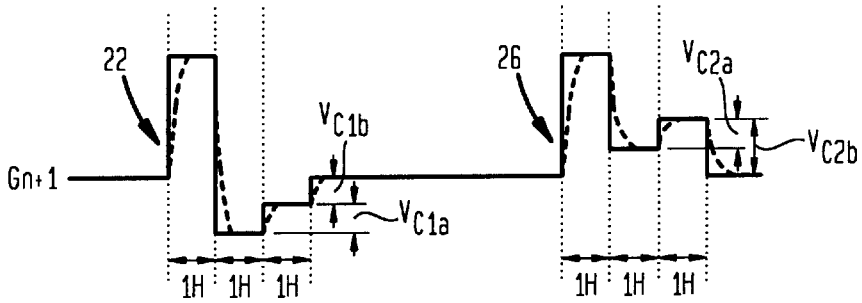
Figure 1C:
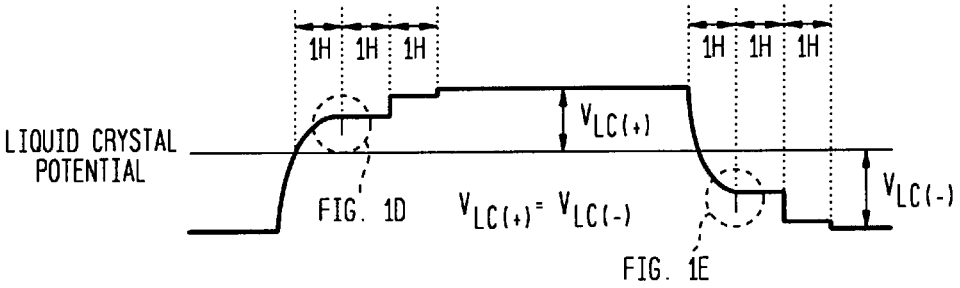
Figure 1D:
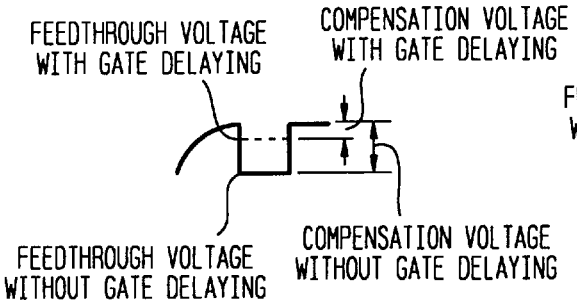
Figure 1E:
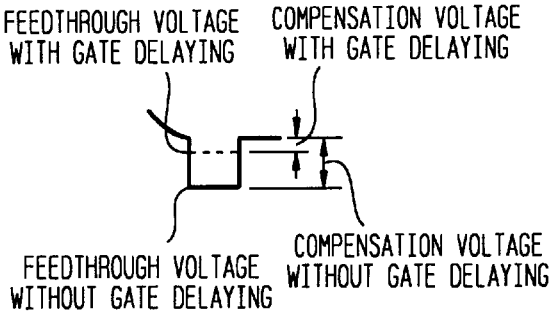
Figure 2A:
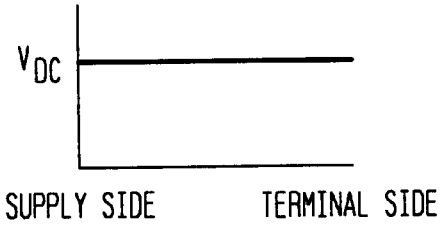
FIG. 2 illustrates the driving method of a liquid crystal display device according to the embodiment of the subject invention.
Figure 2B:
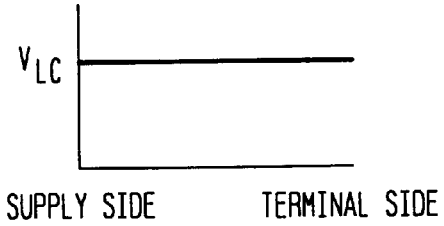
Figure 3:
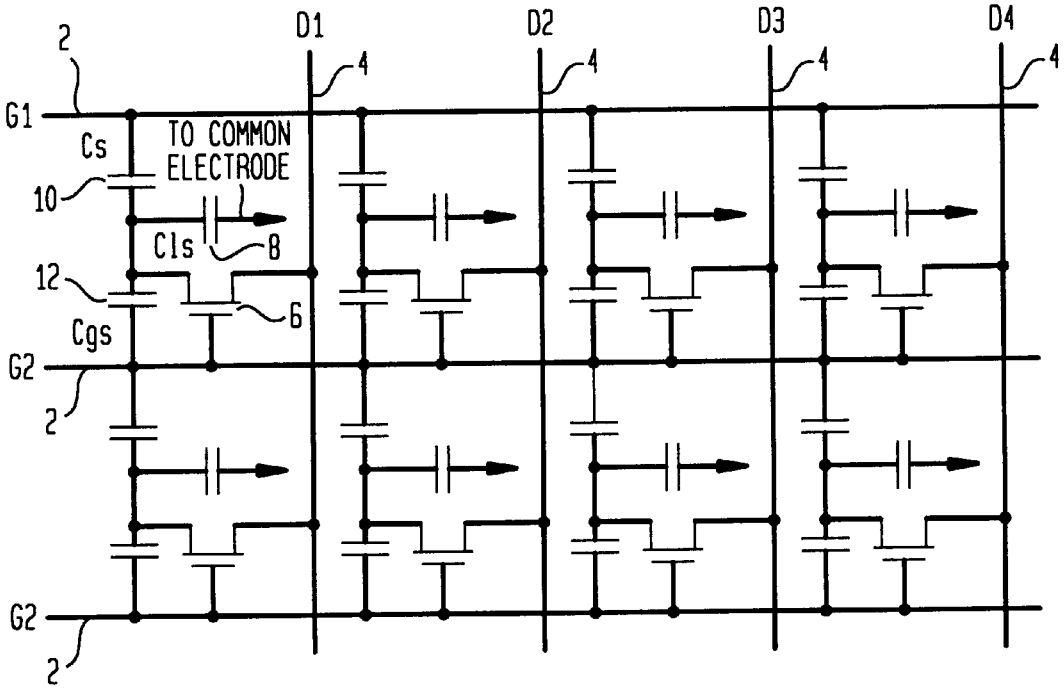
FIG. 3 shows an equivalent circuit of a Cs-on-gate type liquid crystal display device.
Figure 10:
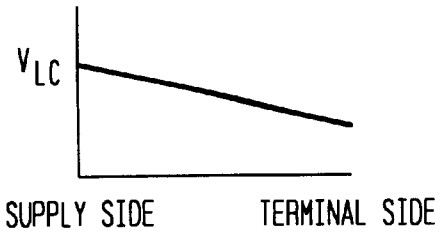
FIG. 10 illustrates the second conventional driving method of a liquid crystal display device.

A driving method of a liquid crystal display according to an embodiment of the subject invention will be described with reference to FIGS. 1 and 2. A liquid crystal display device used in this embodiment of the invention is an active matrix liquid crystal display device in which TFTs are used as switching elements, and is of the Cs-on-gate type. Since the liquid crystal display of this embodiment is the same as that described in the above background art part in connection with FIG. 3, it will not be described here.

FIG. 1 shows two kinds of driving waveforms for gate lines according to this embodiment of the invention. Waveforms drawn by solid lines are those on the side close to the gate line driving circuit, and are not distorted because of no gate delaying. Waveforms drawn by broken lines are those on the side far from the gate line driving circuit, i.e., close to the gate line end portions, and are distorted due to gate delaying.

First, a description will be made of the case of no gate delaying (solid-line waveforms).

As shown in FIG. 1(*b*), a TFT connected to the (n+1)th gate line Gn+1 is turned on by a gate signal (pulse width: 1 H (one horizontal scanning period)) 22 that is input to that gate line, and a voltage is applied to the liquid crystal as shown in FIG. 1(*c*). As shown in FIG. 1(*c*), when the TFT is turned off, the write voltage to the liquid crystal is reduced by a feedthrough voltage due to a feedthrough phenomenon that is caused by a fall of the gate signal 22.

However, feedthrough voltage compensation is effected by increasing the level of a previous gate line Gn to a potential Vc1*a* as shown in FIG. 1(*a*) at the same timing as the fall of the gate signal 22 being input to the gate line Gn+1. The potential Vc1*a* may be set at a voltage level for compensating for the feedthrough voltage with no consideration on the gate delaying.

Thereafter, for instance, after a lapse of 1 H, the potential of the gate line Gn+1 is raised to Vc1*a* and, at the same time, the potential of the previous gate line Gn is raised from Vc1*a* to Vc1*b*. Raising the potential level of the gate line Gn+1 to Vc1*a* has an effect of feedthrough voltage compensation on the liquid crystal of a pixel connected to a next gate line Gn+2.

Final effective value compensation is effected on a pixel that is connected to the gate line Gn+1 by increasing the potential of the gate line Gn+1 to Vc1*b* after a lapse of 1 H, for instance. (FIG. 1(*c*))

In this manner, in the driving method of the invention, the feedthrough voltage compensation potential Vc1*a* and the effective value compensation potential Vc1*b* are applied to the auxiliary capacitor Cs separately, i.e., in two stages. As shown in FIG. 1, as a result of the feedthrough voltage compensation and the effective value compensation, the liquid crystal potential is set at Vlc(+) during frame 1.

Next, in frame 2, to AC-drive the liquid crystal, the feedthrough voltage compensation is effected at a voltage level Vc2*a* and then the effective value compensation is effected at Vc2*b* by a process similar to that in frame 1 so that the liquid crystal potential becomes Vlc(−).

Now, a description will be of a case where gate delaying occurs (broken-line waveforms in FIG. 1).

As shown in FIG. 1(*b*), the TFT connected to the (n+1)th gate line Gn+1 is turned on by a gate signal 22 that is input to the gate line Gn+1 and that is distorted by gate delaying, and a voltage is applied to the liquid crystal as shown in FIG. 1(*c*). As shown in FIG. 1(*c*), when the TFT is turned off, the charged voltage to the liquid crystal is reduced by a feedthrough voltage due to a feedthrough phenomenon that is caused by a fall of the gate signal 22. However, as shown in FIG. 1(*d*), since the gate delaying elongates the gate-on period during which a gate-source current flows, the feedthrough voltage decreases from the case of no gate delaying.

However, since the fall timing of the gate signal 22 being input to the gate line Gn+1 is made coincident with the time of increasing the potential level of the previous gate line Gn to Vc1*a*, the feedthrough voltage compensation potential Vc1*a* is also decreased by the gate delaying though the feedthrough voltage is smaller at a position closer to the gate line terminal portion. Therefore, the feedthrough compensation voltage, which is supplied from the gate line driving circuit, can prevent the liquid crystal potential from having a DC component even without considering the gate delaying.

Since as described above a variation of the feedthrough voltage due to the gate delaying is correctly compensated for at the first stage, the effective value compensation is effected after a lapse of, for instance, 1 H at the second stage in the same manner as in the case of no gate delaying. That is, the potential of the gate line Gn+1 is raised to Vc1*a* and, at the same time, the potential of the previous gate line Gn is raised from Vc1*a* to Vc1*b*. Final effective value compensation is effected on a pixel that is connected to the gate line Gn+1 by increasing the potential of the gate line Gn+1 to Vc1*b* after a lapse of 1 H, for instance. (FIG. 1(*c*))

In this manner, in the driving method of the invention, the feedthrough voltage compensation potential Vc1*a* and the effective value compensation potential Vc1*b* are applied to the auxiliary capacitor Cs separately, i.e., in two stages. Since the effective value compensation is effected after the feedthrough voltage compensation has been effected at the first stage, there does not occur an event that the effective value compensation effect is smaller at a position closer to the gate line terminal portion.

In frame 2, the feedthrough voltage compensation is effected at a voltage level Vc2*a* and then the effective value compensation is effected at Vc2*b* in the same manner as in frame 1. As a result, as shown in FIGS. 2(*a*) and 2(*b*), the feedthrough voltage causes no DC component in the liquid crystal potential and a variation in the effective value compensation causes no unevenness in the brightness of display over the entire gate line. Thus, a liquid crystal display can be realized which can be driven with a low power consumption.

Figure 11A:
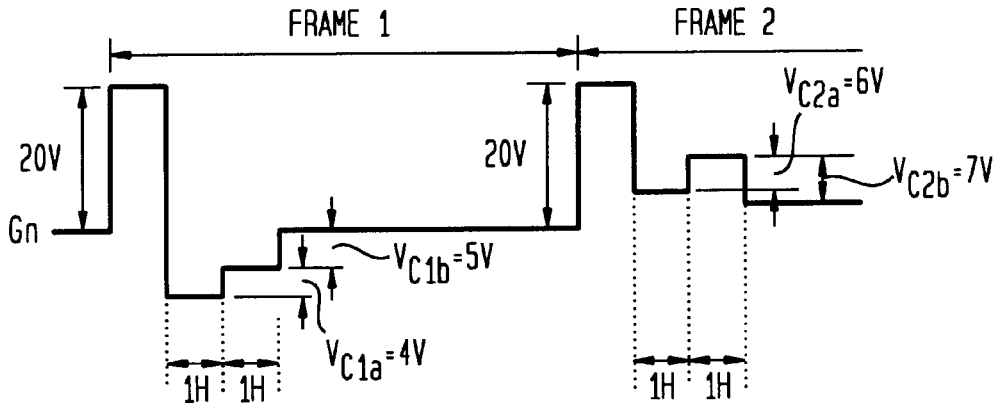
FIG. 11 illustrates a driving method of a liquid crystal display device according to an embodiment of the invention.
Figure 11B:
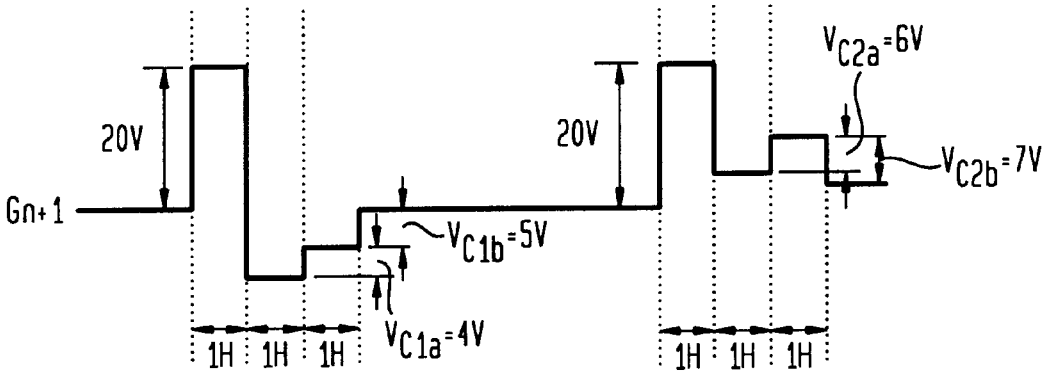
Figure 11C:
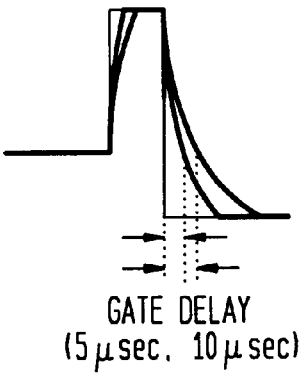

FIG. 11 shows an embodiment of drive waveforms in a case where frame inversion driving is performed on a Cs-on-gate type liquid crystal display device. Respective capacitance ratios and an effective compensation value (ΔV in Equation (1)) used in this embodiment are Cgs/Cs=0.2

Cs/Call=0.2 (Call=Cs+Cgs+Clc)

ΔV=1.2 V.

As shown in FIG. 11(*c*), delays in terms of a time constant on the gate line terminal side were 5 μsec and 10 μsec.

The driving voltages and timings were such that after a gate-on voltage 20 V is output for 1 H, feedthrough voltage compensation is effected by outputting a first compensation voltage (4 V in frame 1 and 6 V in frame 2) at the same timing as a gate-off timing, and then effective value compensation is effected by outputting a second compensation voltage (5 V in frame 1 and 7 V in frame 2) after a lapse of 1 H.

Figure 4A:
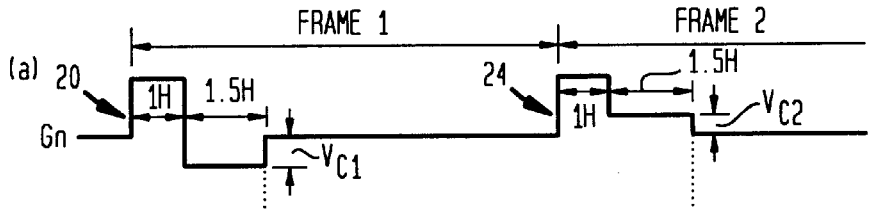
FIG. 4 illustrates a conventional driving method of a liquid crystal display device.
Figure 4B:
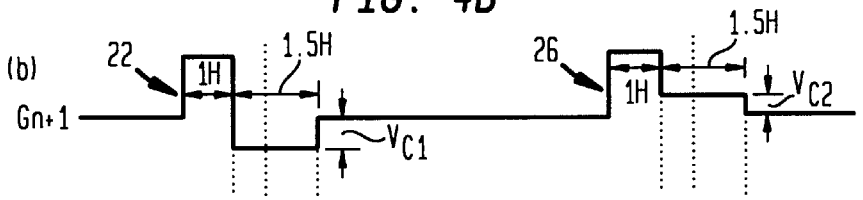
Figure 4C:
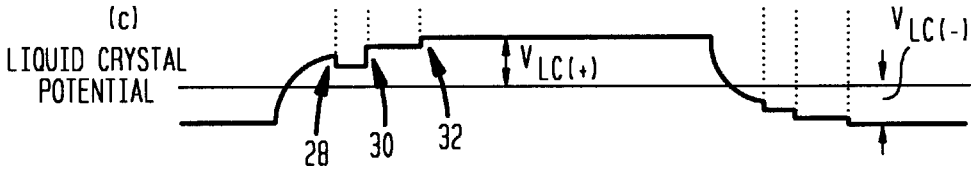
Figure 5A:
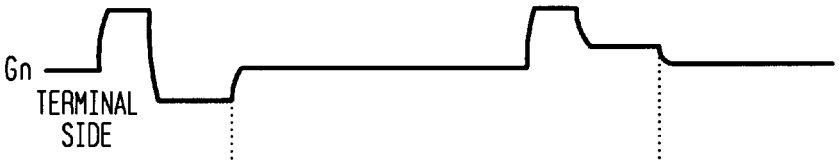
FIG. 5 illustrates the conventional driving method of a liquid crystal display device.
Figure 5B:
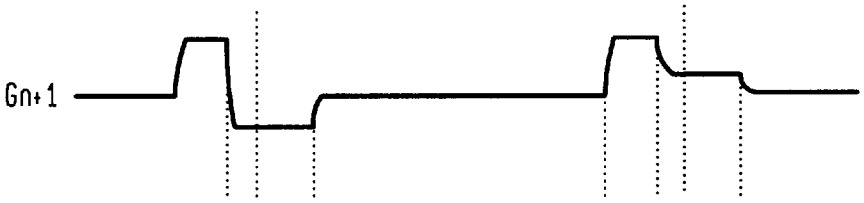
Figure 5C:
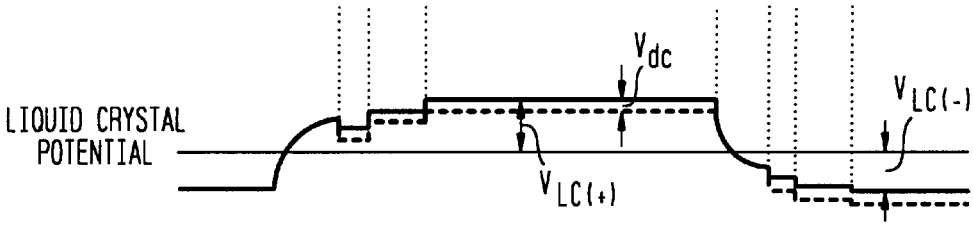
Figure 6:
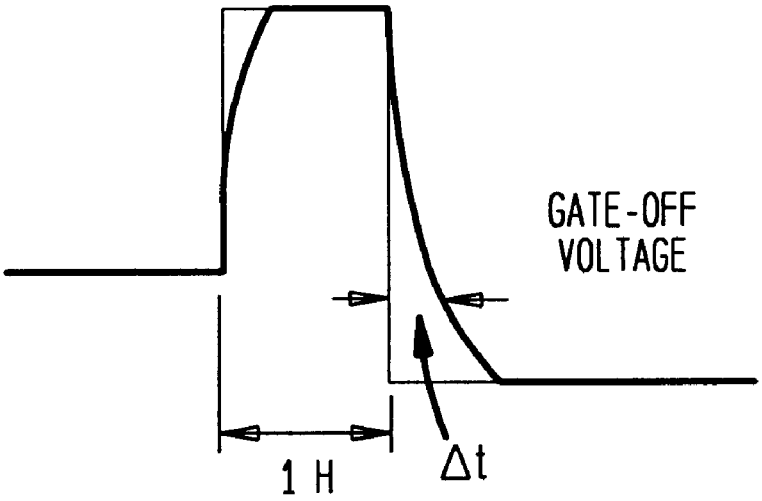
FIG. 6 illustrates the conventional driving method of a liquid crystal display device.
Figure 7:
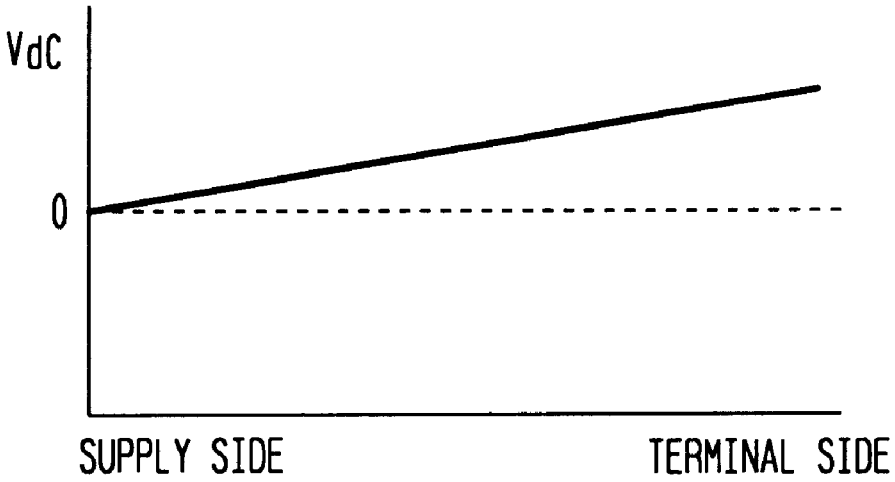
FIG. 7 illustrates the conventional driving method of a liquid crystal display device.

A description will be made of the occurrence of a DC component on the gate signal supply side and on the terminal side due to the gate delaying with reference to FIG. 12(*a*), which compares the driving method of this embodiment and the conventional driving method. The conventional driving method shown in this figure is similar to that shown in FIG. 4. However, while in the driving method of FIG. 4 Vc1 and Vc2 are output after a lapse of 0.5 H from the rise of the gate signal 22, in the comparative example for this embodiment they are output after a lapse of 1 H from the rise of the gate signal 22. In the conventional driving method, DC component variations of about 120 mV and about 200 Mv occurred with gate delays of 5 μsec and 10 μsec, respectively. It was confirmed that the delay compensation driving of the invention could suppress the DC component to about 20 Mv and about 30 Mv for gate delays of 5 μsec and 10 μsec, respectively.

Next, with reference to FIG. 12(*b*), a description will be made of the brightness variation in the driving method of the invention and the conventional driving method. The vertical axis of FIG. 12(*b*) represents a variation of a source driver output voltage with a liquid crystal transmittance of 50%.

Figure 8A:
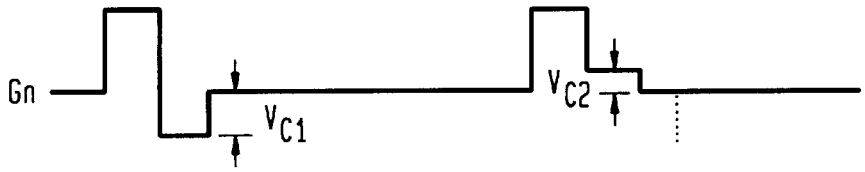
FIG. 8 illustrates a second conventional driving method of a liquid crystal display device.
Figure 8B:
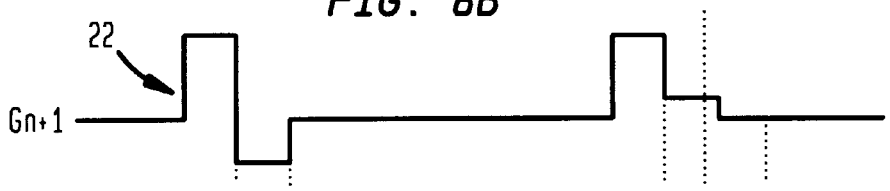
Figure 8C:
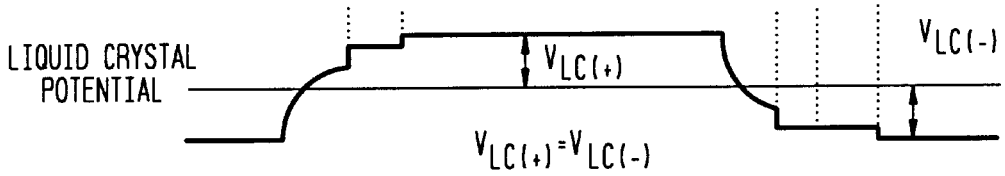
Figure 9A:
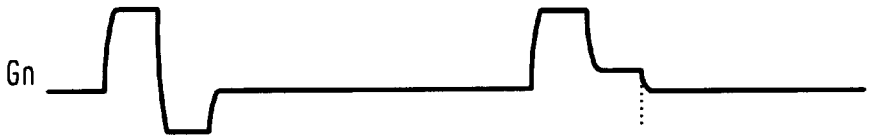
FIG. 9 illustrates the second conventional driving method of a liquid crystal display device.
Figure 9B:
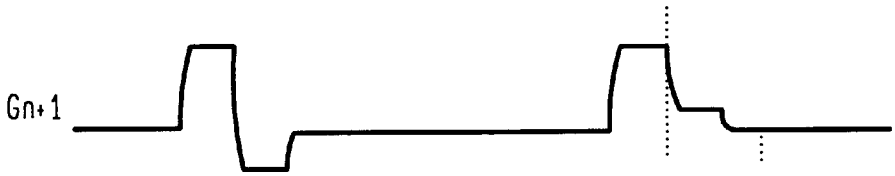
Figure 9C:
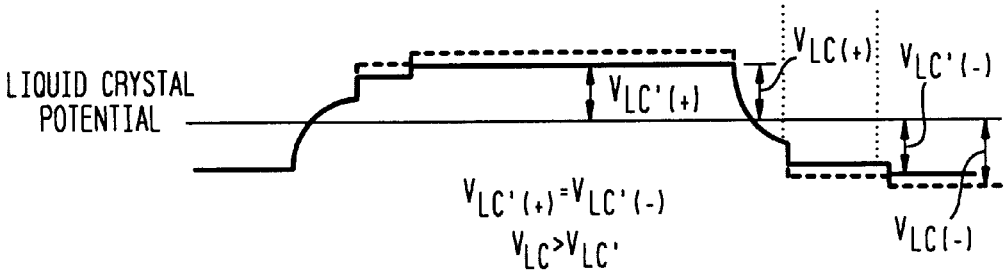
Figure 12A:
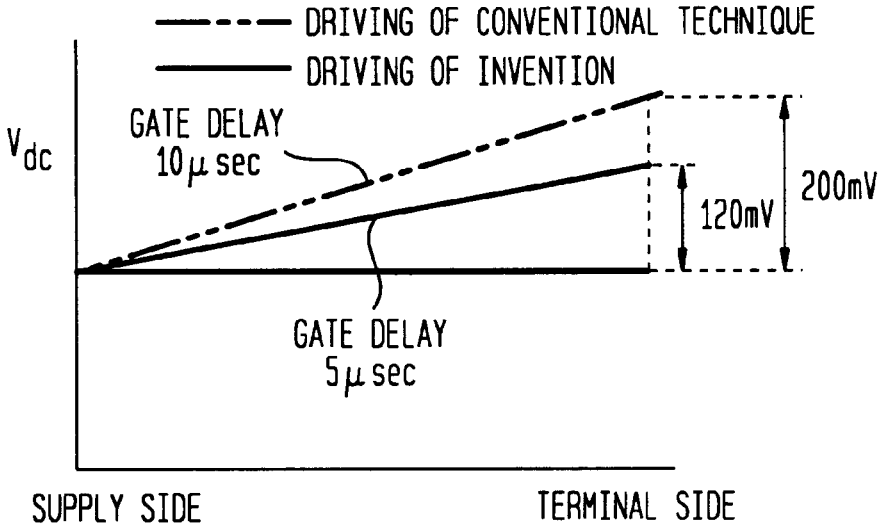
FIG. 12 illustrates the driving method of a liquid crystal display device according to the embodiment of the invention.
Figure 12B:
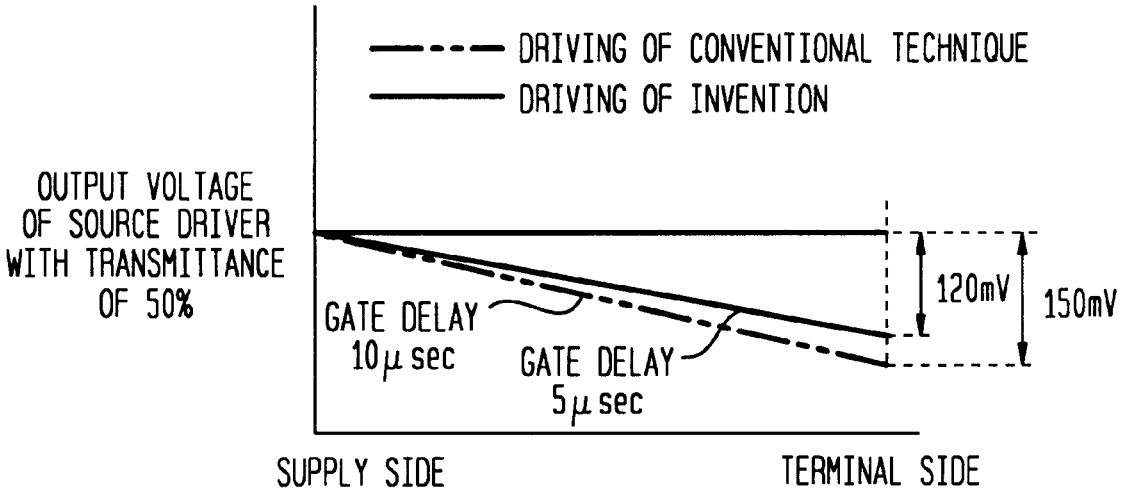

The conventional driving method shown in FIG. 12(*b*) is similar to that shown in FIG. 8. In this conventional driving method, variations of about 120 mV and about 150 mV occurred with gate delays of 5 μsec and 10 μsec, respectively. In the delay compensation driving of the invention, it was confirmed that the variation could be suppressed to about 20 mV for both gate delays of 5 μsec and 10 μsec.

The invention is not limited to the above embodiments, but can be modified in a variety of manners.

For example, although in the above embodiments the invention is applied to the frame inversion driving method, the invention is not limited to such a case but can also be applicable to what is called common alternation driving and H common alternation driving.

Although the above embodiments are directed to the liquid crystal display device in which the auxiliary capacitor is formed on the previous gate line, the invention is not limited to such a case but is naturally applicable to an auxiliary capacitor type liquid crystal display in which storage capacitance lines are separately provided.

Further, although it is necessary that the feedthrough voltage compensation signals Vc1*a* and Vc2*a* that are input to the previous gate line be caused to rise (or fall) approximately at the same timing as the fall of the gate signal, it is not always necessary that the effective value compensation voltages Vc1*b* and Vc2*b* be input after a lapse of 1 H as exemplified in the above embodiments. They may be input after a lapse of a period shorter or longer than 1 H. Where they are input after a lapse of a period shorter than 1 H, the input timing needs to be after the completion of the feedthrough voltage compensation. Therefore, the input timing should be determined at least in consideration of the gate delay time.

Description of Symbols

2 . . . Gate line
4 . . . Data line
6 . . . TFT
8 . . . Clc
10 . . . Cs
12 . . . Cgs
20, 22, 24, 26 . . . Gate signal

What is claimed is:

1. A liquid crystal display device divided into an array of pixel areas each having a display electrode driven through a thin film transistor attached along a gate line with other thin film transistors for driving other display electrodes in a line of said display electrodes, which display electrodes are capacitively coupled to another line to form an auxiliary capacitance, said liquid crystal display device being characterized by:

a) drive means for applying a gate line signal through said gate line to said thin film transistors of said line of display electrodes; and b) compensation means for supplying to said line of said display electrodes first a feedthrough compensation voltage followed by a value compensation voltage.

2. The liquid crystal display device of claim 1 wherein said another line is a gate line of another line of said display electrodes.

3. The liquid crystal display device of claim 1 wherein said another line is an independent storage capacitance line.

4. The liquid crystal display device of claim 1 wherein said compensation means is for applying the feedthrough compensation voltage at the fall of the gate line signal.

5. The liquid crystal display device of claim 4 wherein said another line is an independent storage capacitance line.

6. The liquid crystal display of claim 1 wherein said another line is the gate line for an adjacent row of display electrodes.

7. In a liquid crystal display device which is divided into an array of pixel areas each having a display electrode driven through a thin film transistor attached along a gate line with other thin film transistors for other display electrodes in a line of said display electrodes, which display electrodes are coupled to another line to form an auxiliary capacitance, the method of operation comprising:

a) applying a gate line signal through said gate line to said thin film transistors of said line of display electrodes; and b) supplying to said display electrodes first a feedthrough compensation voltage followed by a value compensation voltage.

8. The method of operation of claim 7 including applying said feedthrough and value compensation voltages to said another line to charge the auxiliary capacitances of said line of said display electrodes.

9. The method of operation of claim 8 including applying the feedthrough compensation voltage at the fall of the gate line signal.

10. A liquid crystal display device divided into an array of pixel areas each having a display electrode driven through a thin film transistor attached along a gate line with other thin film transistors for driving other display electrodes in a line of said display electrodes, which display electrodes are capacitively coupled to another gate line to form an auxiliary capacitance, said liquid crystal display device being characterized by:

a) drive means for applying a gate line signal through said gate line to said thin film transistors of said line of display electrodes; and b) compensation means for supplying to said line of said display electrodes first a feedthrough compensation voltage followed by a value compensation voltage through said another gate line to charge the auxiliary capacitances of said line of said display electrodes.

11. The liquid crystal display of claim 10 wherein said another gate line is a gate line for an adjacent row of display electrodes.

12. The liquid crystal display device of claim 11 wherein said compensation means is for applying the feedthrough compensation voltage at the fall of the gate line signal.

13. In a liquid crystal display device which is divided into an array of pixel areas each having a display electrode driven through a thin film transistor attached along a gate line with other thin film transistors for other display electrodes in a line of said display electrodes which display electrodes are coupled to another gate line of an adjacent row of thin film transistors to form an auxiliary capacitance, the method of operation comprising:

a) applying a gate line signal through said gate line to said thin film transistors of said line of display electrodes; and b) supplying to said display electrodes through said another gate line, first a feedthrough compensation voltage followed by a value compensation voltage.

14. The method of operation of claim 13 including applying said feedthrough and value compensation voltages to said another gate line to charge the auxiliary capacitances of said line of said display electrodes.

15. The method of operation of claim 14 including applying the feedthrough compensation voltage at the fall of the gate line signal.

* * * * *